United States Patent [19]

Hayashi et al.

[11] Patent Number: 5,054,304

[45] Date of Patent: Oct. 8, 1991

[54] SHEET STOCK FEED LINE WITH DECELERATION AND ACCELERATION

[75] Inventors: Shigeki Hayashi; Shigeru Kusaka, both of Machida, Japan

[73] Assignee: Nusco Co., Ltd., Tokyo, Japan

[21] Appl. No.: 481,164

[22] Filed: Feb. 20, 1990

[30] Foreign Application Priority Data

Mar. 27, 1989 [JP] Japan ..... 1-75629

[51] Int. Cl.[5] ..... B21F 11/00

[52] U.S. Cl. ..... 72/131; 83/65

[58] Field of Search ..... 72/160, 131; 226/8, 226/4, 122; 83/236, 65

[56] References Cited

U.S. PATENT DOCUMENTS 3,757,619 9/1973 Gianese ..... 83/236

FOREIGN PATENT DOCUMENTS 0025047 6/1987 Japan ..... 72/160

1022157 6/1964 United Kingdom ..... 83/236

*Primary Examiner*—Lowell A. Larson

*Assistant Examiner*—Michael J. McKeon

*Attorney, Agent, or Firm*—Pollock, Vande Sande and Priddy

[57] ABSTRACT

A sheet stock feed line in which sheet stock is leveled and fed by a leveler to a feeder and each time the feeder feeds the sheet stock by a predetermined length, the feed by the feeder is stopped for working the sheet stock. While the feed by the feeder is stopped, the leveler feeds the sheet stock at a very low feed rate to form a loop of the sheet stock between the leveler and the feeder. When the loops reaches a predetermined size, the feeder resumes the feed of the sheet stock and the leveler is controlled so that its feed amount follows that by the feeder.

8 Claims, 5 Drawing Sheets

SHEET STOCK FEED LINE WITH DECELERATION AND ACCELERATION

BACKGROUND OF THE INVENTION

The present invention relates to a sheet stock feed line in which ferrous or nonferrous sheet stock is fed by a feeder to a tool for cutting, press, or similar machining operation.

FIG. 1 shows a widely used sheet stock feed line in which sheet stock is fed a predetermined length by a feeder for cutting by a shear. In this prior art example, ferrous or nonferrous sheet stock 12 rolled on an uncoiler 11 is unrolled and straightened or flattened by a leveler 13 which serves also as a feeder, thereafter being fed to a shear 14. The leveler 13 is driven by a motor 16 through a reducer 15. Pulses corresponding to the revolution of the motor 16 are generated by a rotary encoder 17 and are supplied to a numerical controller 18, which responds to the pulses to effect numerical control of the motor 16 to feed the sheet stock 12 a predetermined length (i.e. a length into which the sheet stock 12 is desired to be cut). After the feed of the sheet stock 12 by the numerical control, a cut command is issued to the shear 14, causing it to cut the sheet stock 12 while the latter is stopped. Upon completion of cutting, the next feed command is provided to the numerical controller 18. By repeating this procedure, the sheet stock 12 is successively cut into preset lengths.

Recently a surface treated sheet, typically, a colored steel sheet, has come into common use. The surface treated sheet is marred easily when the leveler 13 is stopped and restarted. This is called a roll mark of the leveler, which is said to be caused by the slipping between rolls of the leveler and the sheet stock when the leveler is started after being stopped. By firmly screwing down the leveler to bring its rolls into tight contact with the sheet stock, the frictional force developed therebetween will prevent the slipping to some extent. For most of recent surface treated sheets, however, the force for screwing down the leveler must be reduced because such sheets are easily injured and marred with a roll mark.

FIG. 2 shows a conventional sheet stock feed line designed to prevent sheet stock from being marred with a roll mark. In this feed line, the sheet stock 12 is fed continuously, without stopping the leveler 13, at such a constant rate that a loop (i.e. the slack or sag in the sheet stock) 25 described later stably remains at substantially the same position. The sheet stock 12 fed by the leveler 13 is fed by a second feeder 19 to the shear or press 14. The feeder 19 is driven by a motor 22 through a reducer 21. A rotary encoder 23 coupled with the motor 22 generates pulses corresponding to its revolution, and the pulses are applied to a numerical controller 24. The numerical controller 24 controls the motor 22 to feed the sheet stock 12 by a preset feed length. When the sheet stock 12 is fed the preset length by this numerical control, the shear or press 14 is actuated to cut or press the sheet stock 12 in the standstill period of the sheet stock 12. Upon completion of the working, the next feed command is issued to the numerical controller 24, thereafter repeating the same operation.

The feeder 19 repeatedly suspends the feed of the sheet stock 12, but since the leveler 13 always feeds the sheet stock 12, the loop 25 of the sheet stock 12 between the leveler 13 and the feeder 19 goes down while the feed of the sheet stock 12 by the feeder 19 is suspended.

The loop 25 goes up by the acceleration of the feeder 19. A pit 26 is provided for receiving the loop 25.

The feed line shown in FIG. 2 calls for the provision of the pit 26 of a size corresponding to a maximum feed length of the sheet stock 12, resulting in increased line length. In order that the flatness of the sheet stock 12, once leveled by the leveler 13, may be prevented from degradation by the formation of the loop 25, it is necessary that the radius of curvature of the loop 25 be large. Hence, the line length inevitably increases.

FIG. 3 shows another conventional sheet stock feed line which is relatively short and does not mar sheet stock. The leveler 13 feeds the sheet stock 12 to a rotary shear 31 at a feed rate dependent on the length into which the sheet stock 12 is to be cut. The rotary shear 31 is driven by a motor 33 through a reducer 32. Pulses corresponding to the revolution of the motor 33 are generated by a rotary encoder 34 coupled therewith and are applied to a numerical controller 35. The numerical controller 35 is also supplied with pulses from a rotary encoder 28 coupled with length measuring rolls 27. The numerical controller 35 controls the motor 33 to drive the rotary shear 31 to make one turn for each preset feed of the sheet stock 12 so that upper and lower cutting edges of the rotary shear 31 mesh with each other to cut the sheet stock 12 at the end of the preset feed thereof. In this instance, the rotary shear 31 is driven at about the same speed as the feed rate of the sheet stock 12 during the shearing work.

In this prior art example, the rotary shear 31 must be sufficiently large and heavy for the shearing work, and consequently, the motor 33 for driving such a shear also needs to be large in power. Accordingly, this feed line inevitably becomes expensive as a whole.

Furthermore, this conventional feed line is not suitable for cutting sheet stock into lengths shorter than the circumference of the addendum circle of the rotary shear (700 mm or so in many cases, represented by $\pi D$, where D is the diameter of the addendum circle), because the feed of sheet stock must be rapidly accelerated and then quickly decelerated for each cutting operation. It is therefore almost impossible to cut sheet stock into a length of, for example, 300 mm. Additionally, the feed rate must be decreased markedly, but at too low feed rates the flywheel effect of the rotary shear is so small that sheet stock cannot be cut only with the force of the motor driving the rotary shear. The feed line shown in FIG. 3 can be used for cutting sheet stock into medium and long sizes, but plants which have direct dealing with end users are required to fill their demands for small numbers of sheets of a large variety of sizes.

SUMMARY OF THE INVENTION

Accordingly, it is an object of the present invention to provide a low-cost, relatively short feed line which neither mars sheet stock with roll marks nor calls for a pit such as needed in the prior art and which permits the use of a small motor and facilitates cutting sheet stock into long to short lengths.

The present invention is based on our success in ascertaining experimentally that acceleration and deceleration of the feed of sheet stock would not leave any roll marks on the sheet stock even at an ultralow feed rate as long as its feed by the leveler is not stopped.

According to the present invention, the sheet stock feed line has an arrangement in which sheet stock is fed first by a first feeder and then by a second feeder to a tool in response to first and second numerical control by numerical control means.

Under the first numerical control the second feeder feeds the sheet stock to the tool and stops the feed at a position corresponding to a predetermined length into which the sheet stock is to be cut, for example. Under the second numerical control, immediately before the second feeder stops the feed, the feed rate of the sheet stock by the first feeder is decreased to form a loop of the sheet stock (or slack off on the sheet stock) between the first and second feeders, and after working of the sheet stock by the tool, the second feeder resumes the feed and starts to increase the feed rate, then the first feeder is also accelerated into synchronism with the second feeder to absorb the loop of the sheet stock (or take up the slack in the sheet stock) until the second feeder stops the feed again.

That is, the second feeder stops the feed each time it has fed the sheet stock by the predetermined length, and after working of the sheet stock by the tool, it resumes the feed. On the other hand, the first feeder continues the feed but its feed rate is lowered just before the second feeder stops the feed. Consequently, the sheet stock forms a loop between the first and second feeders, but the sag in the loop is small because the feed rate of the sheet stock by the first feeder is very low. When the second feeder resumes the feed and begins to speed up, then the first feeder also starts to speed up correspondingly, and the first and second feeders have a servo relation and are synchronized with each other while absorbing the loop of the sheet stock until the moment immediately before the second feeder stops. Accordingly, the sheet stock is fed with practically no or a very small amount of loop remaining unabsorbed.

DESCRIPTION OF THE PREFERRED EMBODIMENTS

Figure 1:
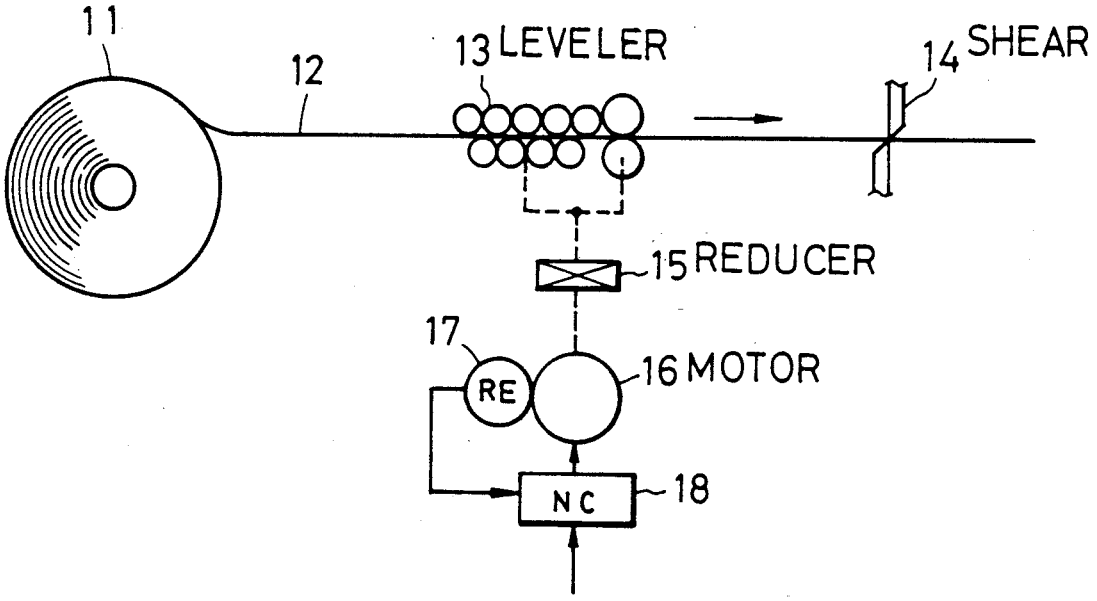
FIG. 1 PRIOR ART
FIG. 1 is a schematic diagram showing a conventional feed line.
Figure 3:
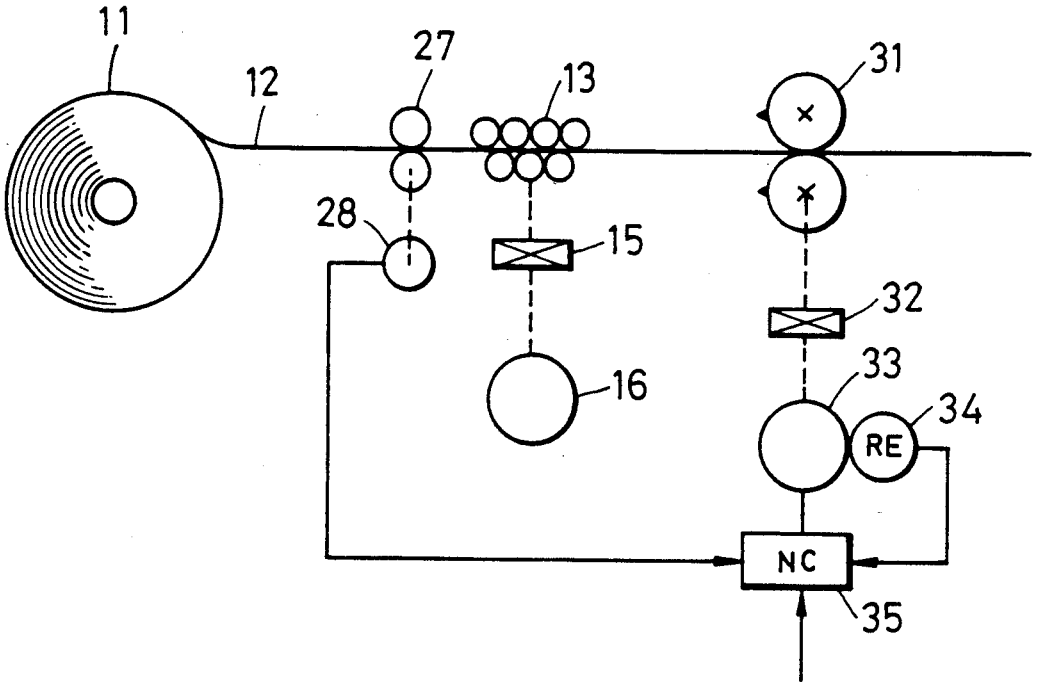
FIG. 3 PRIOR ART
FIG. 3 is a schematic diagram showing yet another conventional feed line.
Figure 2:
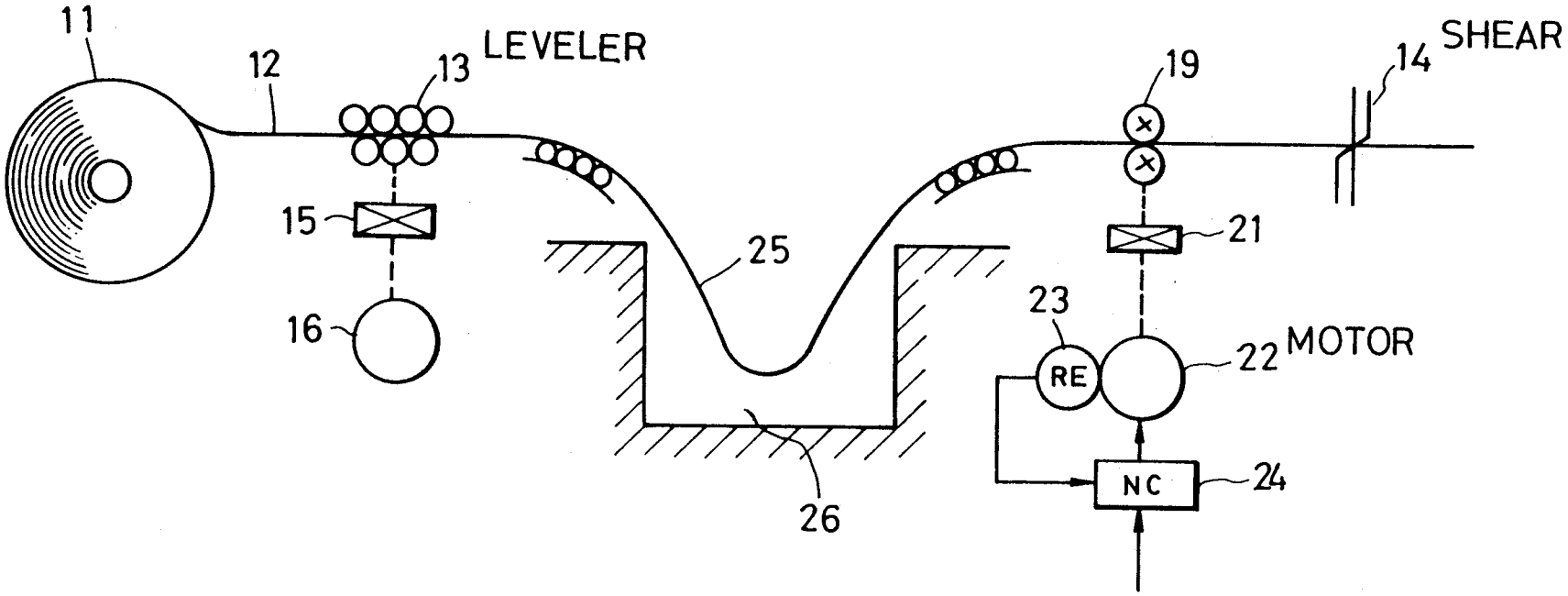
FIG. 2 PRIOR ART
FIG. 2 is a schematic diagram showing another conventional feed line.
Figure 4:
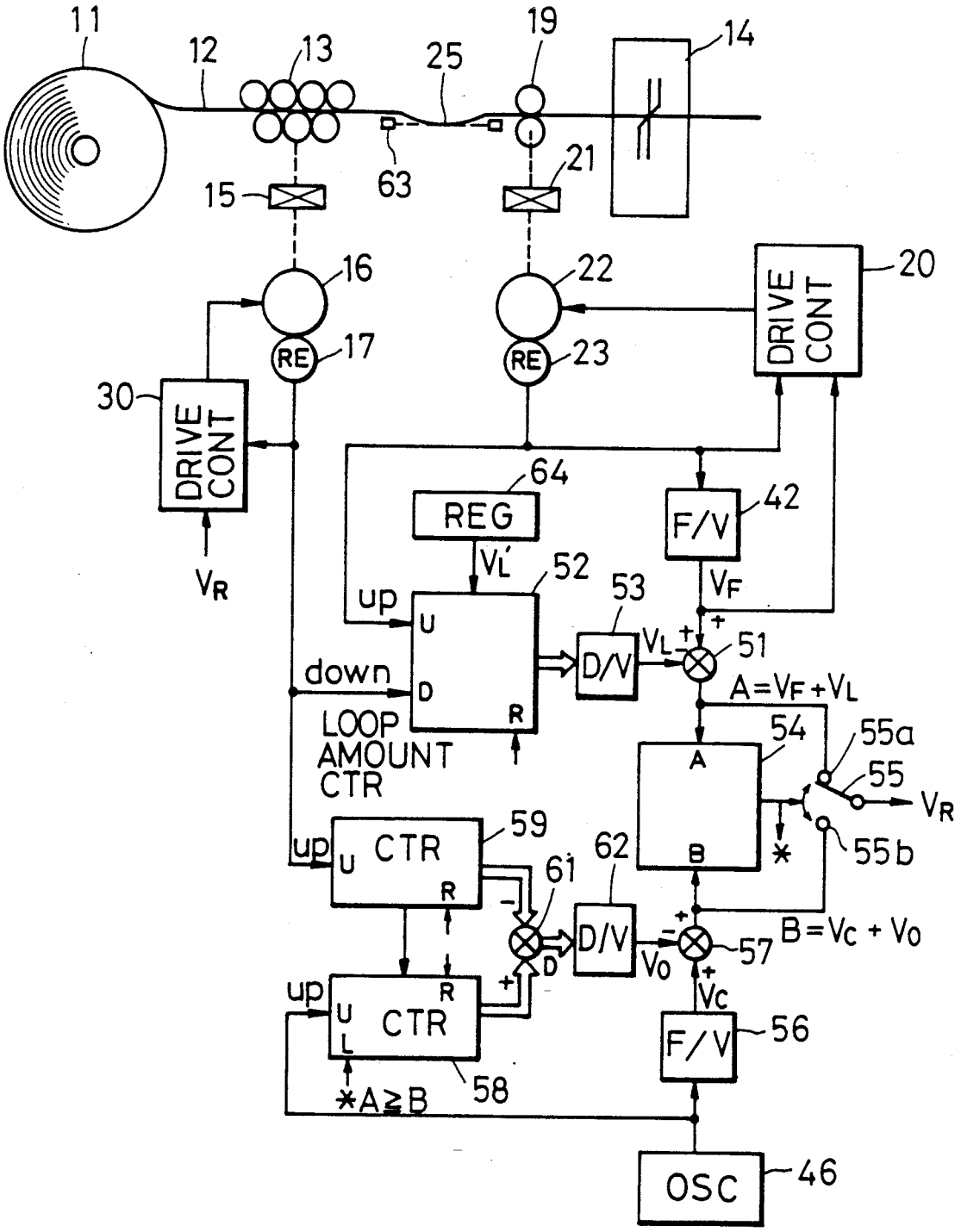
FIG. 4 is a block diagram illustrating the principal part of an embodiment of the present invention.

FIG. 4 illustrates an embodiment of the present invention, in which the parts corresponding to those in FIGS. 1, 2 and 3 are identified by the same reference numerals. The sheet stock 12 rolled on the uncoiler 11 is unrolled and is fed first by the leveler 13 acting as a first feeder and then by the second feeder 19 to the shear 14. The leveler 13 is driven by the motor 16 through the reducer 15, whereas the second feeder 19 is driven by the motor 22 through the reducer 21.

Figure 5:
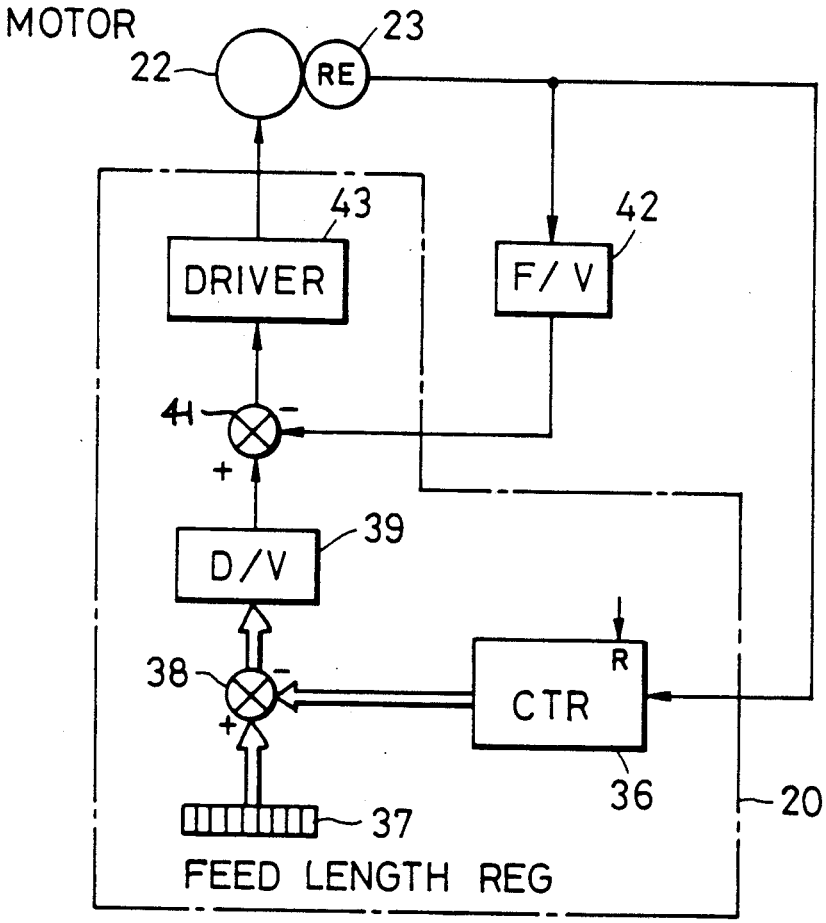
FIG. 5 is a block diagram showing an example of first numerical control for a second feeder.

The second feeder 19 responds to first numerical control to stop the sheet stock 12 at a position corresponding to a predetermined length into which the sheet stock 12 is to be cut. To perform this, a drive control unit 20 is provided as shown in FIG. 5. In the drive control unit 20 pulses generated by the rotary encoder 23 corresponding to the revolution of the motor 22 are counted by a counter 36 which is reset for each cutting of the sheet stock 12. The count value of the counter 36 and a feed length set in a feed length register 37 are subtracted one from the other in a subtractor 38. The subtractor output is converted by a numerical-velocity converter 39 into a velocity reference value. The velocity reference value thus obtained is provided to a subtractor 41, which performs a subtraction between the velocity reference value and a velocity feedback value available from a frequency-velocity converter 42 supplied with the pulses from the rotary encoder 23. The subtractor output is provided to a driver 43 to drive the motor 22.

Figure 6A:
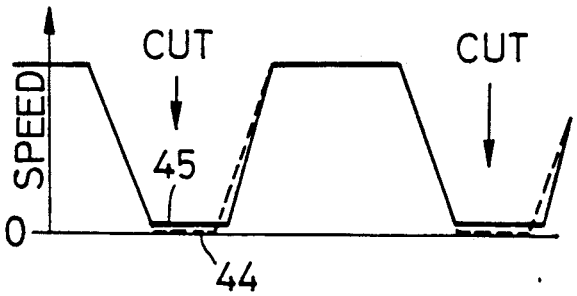
FIGS. 6A and 6B are diagrams showing, by way of example, speed changes of motors 16 and 22.

When the preset feed length is long, the motor 22 is accelerated to a certain speed, at which it is held for a certain period of time, and as the count value of the counter 36 approaches the preset feed length, the motor 22 is decelerated and is then stopped when they agree, as indicated by the broken line 44 (which partly overlaps the solid line 45) in FIG. 6A. When the motor 22 comes to a halt, a cut command is issued to the shear 14, actuating its upper and lower cutting edges to cut the sheet stock 12. Upon completion of this cutting, the counter 36 is reset by the output of a loop sensor 63, so that a numerical value corresponding to the preset feed length is provided again to the numerical-velocity converter 39 to thereby accelerate the motor 22. When the preset feed length is short, the output of the subtractor 38 diminishes before the motor 22 reaches a maximum speed, and the motor 22 is decelerated accordingly and is then stopped when the sheet stock 12 has just been fed by the preset feed length, as indicated by the broken line in FIG. 6B.

Figure 6B:
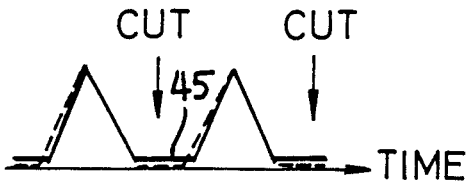

The feed rate by the leveler 13, which performs the function of a first feeder as well, undergoes such changes as indicated by the solid line 45 in FIGS. 6A and 6B. That is, immediately before the feeder 19 stops, the leveler 13 breaks its follow-up servo relation with the feeder 19 and continues to feed the sheet stock 12 at a lower speed. Consequently, the loop 25 of the sheet stock 12 is formed between the leveler 13 and the feeder 19 while the latter stands still for the shearing work. Next, when the feeder 19 starts to accelerate and the loop 25 begins to rise accordingly, the leveler 13 also starts to accelerate and then resumes the servo relation with the feeder 19 to follow up its operation while absorbing the loop 25 until the moment just before the feeder 19 stops again.

Figure 7:
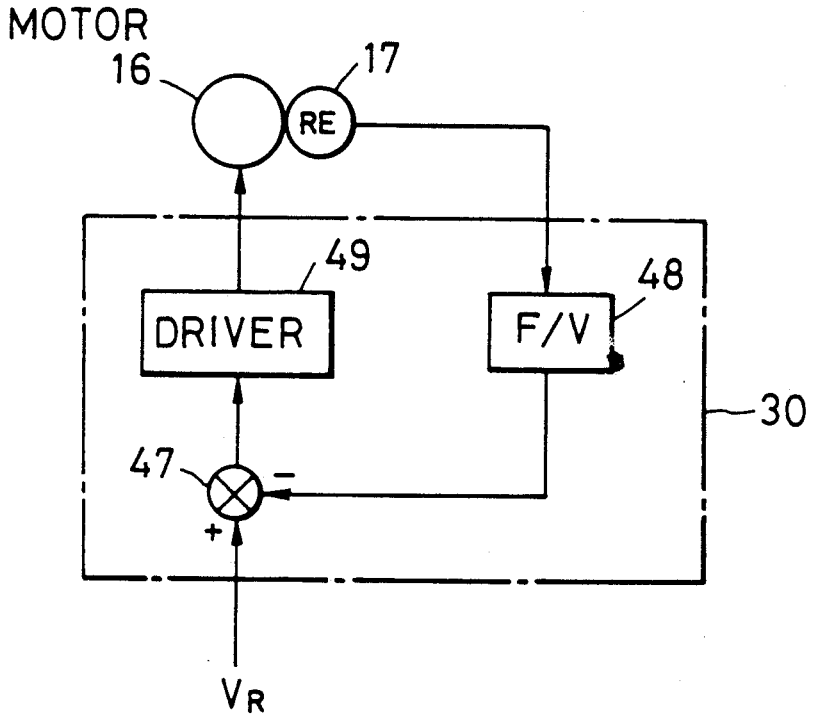
FIG. 7 is a block diagram showing an example of speed control of a first feeder.

Referring now to FIG. 4, a detailed description will be given of the second numerical control outlined above. A leveler velocity reference $V_R$ is produced on the basis of pulses from the rotary encoders 17 and 23 and output pulses from an oscillator 46 for creep rate generation use. The velocity reference $V_R$ is supplied to a subtractor 47 of a drive control unit 30 shown in FIG. 7. The pulses from the rotary encoder 17 are applied to a frequency-velocity converter 48, the output of which is provided as a velocity feedback of the motor 16 to the subtractor 47. The motor 16 is driven by the output of the subtractor 47 via a driver 49 and the speed of the motor 16 is controlled to agree with the leveler velocity reference $V_R$.

A description will be given, with reference to FIG. 4, of how the leveler velocity reference $V_R$ is produced. The pulses from the rotary encoder 23 are applied to a frequency-velocity converter 42 to detect a velocity component $V_F$ of the motor 22, which is provided to an adder 51. The pulses from the rotary encoder 23 are counted up by a loop amount counter 52, which, in turn, counts down the pulses from the rotary encoder 17. The count value of the loop amount counter 52 is converted by a numerical-velocity converter 53 into a velocity component $V_L$, which is provided to the adder 51. The output, $A=V_F+V_L$, from the adder 51 is applied to a comparator 54 and a fixed contact 55*a* of a changeover switch 55. The output pulses from the oscillator 46 for creep rate generation use are supplied to a frequency-velocity converter 56, whose output $V_C$ is provided to an adder 57. The output pulses from the oscillator 46 are counted up by a counter 58 and the output pulses from the rotary encoder 17 are also counted up by a counter 59. The count values of the counters 58 and 59 are subtracted one from the other in a subtractor 61, whose output is converted by a numerical-velocity converter 62 into a velocity component $V_O$. The velocity value $V_O$ thus obtained is provided to the adder 57 and its output, $B=V_C+V_O$, is applied to the comparator 54 and a fixed contact 55*b* of the changeover switch 55.

The changeover switch 55 is controlled according to the result of comparison by the comparator 54 in such a manner that the switch 55 is connected to the fixed contact 55*a* or 55*b* depending on whether $A \geqq B$ or $B>A$. While $A \geqq B$, the count value of the counter 59 is loaded into the counter 58. The output of the changeover switch 55 is used as the leveler velocity reference $V_R$.

Now, the operation sequence of this feed line will be described. At first, the sheet stock 12 is mounted on the feed line, and in this case, the loop 25 is not formed yet. Then the feed line is switched to the automatic mode. At this time, the counters 52, 58 and 59 are reset. The counter 36 and the feed length register 37 (FIG. 5) are also reset. Accordingly, the feeder 19 is at a standstill, the output $V_F$ of the frequency-velocity converter 42 and the count value of the loop amount counter 52 are both zeros, and $A=V_F+V_L=0$. On the other hand, since the outputs of the counters 58 and 59 are zeros, $V_O=0$, but since $V_C$ is always a positive constant value, $B>A$. Consequently, the switch 55 is connected to the fixed contact 55*b* and the output $V_C$ of the frequency-velocity converter 56 is used as the leveler velocity reference $V_R$. Based on this, the leveler 13 starts the feed at a creep rate. At this time, since $B>A$, the counters 58 and 59 count pulses from the oscillator 46 and the rotary encoder 17, respectively, and the difference between their count values is converted into the velocity signal $V_O$, which is applied to the adder 57. Thus, the motor 16 for driving the leveler 13 follows the velocity signal $V_C$ as its velocity reference.

Since the feeder 19 is still at a standstill, the sheet stock 12 forms the loop 25. When the loop 25 reaches a predetermined depth, it is detected by the loop sensor 63, and in response to its output, a feed length is set in the register 36, starting the feeder 19. At this time, the output $V_L$ of the numerical-velocity converter 53 is negative, because the loop amount counter 52 has counted down the pulses of the rotary encoder 17 until then. In the embodiment shown in FIG. 4 a fixed negative value $V_L'$ preset in a register 64 is loaded into the loop amount counter 52 for each outputting of the loop sensor 63 so that feed measurement errors on the leveler 13 side and the feeder 19 side are not accumulated in the loop amount counter 52 as the shearing work is repeated. The motor 22 is accelerated and the output $V_F$ of the frequency-velocity converter 42 is also increased, and when the output A of the adder 51 quickly increases from a negative value and becomes equal to or greater than the output B of the adder 57, the switch 55 is changed over to the fixed contact 55*a*. As a result of this, the output, $A=V_F+V_L'$ of the adder 51 becomes the leveler velocity reference $V_R$ and the feed rate by the leveler 13 starts to follow the feed rate by the feeder 19. Because of follow-up control, the output $V_L$ of the numerical-velocity converter 53 is reduced to substantially zero and the loop 25 in the sheet stock 12 is thus absorbed.

When the feed of the sheet stock 12 approaches the predetermined feed length, that is, just before the feeder 19 is to stop, the speed $V_F$ of the motor 22 decreases and the output A of the adder 51 also decreases and becomes smaller than the output B of the adder 57. Thus, the switch 55 is changed over to the fixed contact 55*b*, and even after the feed by the feeder 19 is stopped, the leveler 13 keeps on feeding the sheet stock 12 at a low speed, following the oscillator 46. In consequence, the sheet stock 12 forms the loop 25. While the feeder 19 is at a standstill, a cut command is issued to the shear 14. Upon completion of the cutting, a feed length is set in the register 37 in response to the output of the loop sensor 63, and at the same time, the counter 36 is reset and the feeder 19 is started again. Thus, the outputs $V_F$ and $V_L$ also increase and the output A becomes equal to or greater than the output B, with the result that the switch 55 is changed over to the fixed contact 55*a* and the feed by the leveler 13 follows the feed by the feeder 19. The above-described operation is repeated for each shearing work.

In the embodiment depicted in FIG. 4 it is possible to omit the loop sensor 63 and start the feeder 19 when the loop amount counter 52 is decremented to a predetermined value. In such an instance, the register 64 may be left out but instead provision can be made for resetting the loop amount counter 52 at the timing of changing over from the fixed contact 55*a* to 55*b* (at the rise or fall of the output of the comparator 54, for example) so as to prevent the accumulation of the aforementioned feed measurement errors. Moreover, instead of resuming the feed by the feeder 19 in response to the output of the loop sensor 63 or the decrement of the loop amount counter 52 to a predetermined value, the feed by the feeder 19 may be resumed by setting the feed length in the register 37 and resetting the counter 36 in response to a cutting end signal from the shear 14 or a certain elapsed time after the end signal. While in FIG. 4 the feed length is measured by counting the output pulses from the encoders 17 and 23 coupled with the motors 16 and 22, it is possible to employ an arrangement in which length measuring rolls are provided at preceding stages of the leveler 13 and the feeder 19 and output pulses from encoders associated with the rolls are counted by counters as in the case of the prior art example shown in FIG. 3. Additionally, it is possible to adopt an arrangement in which the counters 58 and 59 and the subtractor 61 in FIG. 4 are replaced by a reversible counter for counting down the output pulses from the rotary encoder 17 and counting up the output pulses from the oscillator 46 and this counting operation is enabled by the output from the comparator 54. Although in the above the numerical control for the motors 16 and 22 is provided by hardware, the structure of FIG. 4, except power units such as the rotary encoders 17, 23 and the drivers 43, 49, may be replaced with software. The present invention has been described in connection with the case of cutting the sheet stock for each feed by a preset length, but the invention is applicable as well to punching or press work of sheet stock while feeding it by a preset length. The motors used in FIG. 4 may be AC or DC motors, and consequently, the drivers may also be vector-control inverters, DC choppers, or thyristor converters.

As described above, according to the present invention, the second feeder 12 feeds sheet stock and determines the position where to stop the feed in accordance with a preset length, and since the feeder 12 is formed by pinch rolls which can be sufficiently screwed down, the sheet stock will not be marred by the start and stop of the feeder 19. On the other hand, since the first feeder 13, which is formed as a leveler and hence readily mars the sheet stock when it is stopped, always keeps on feeding the sheet stock without stopping, there is no fear of marring the sheet stock with roll marks. Since the feed rate by the first feeder 13 is very low while the second feeder 19 is at a standstill, the sag of loop 25 formed during this time is so small that no pit is needed. In addition, the second feeder 19 occupies only the small space needed by a narrow roll stand. Accordingly, the entire line length is short. The feed line of the present invention does not use a tool which performs flying work, such as a rotary shear, and hence is low-cost and permits easy working of sheet stock over a very wide range of set lengths.

It will be apparent that many modifications and variations may be effected without departing from the scope of the novel concepts of the present invention.

What is claimed is:

1. A sheet stock feed line comprising:

first feed means for feeding sheet stock;

first drive control means for controlling the operation of said first feed means;

second feed means for receiving sheet stock fed by said first fed means and for feeding said sheet stock to a tool for working;

second drive control means for controlling said second feed means and operative to decelerate said second feed means to a halt each time the length of said sheet stock fed by said second feed means reaches a preset length so that said sheet stock can be worked by said tool during said halt, said second drive control means being operative thereafter to accelerate said second feed means to resume the feeding of said sheet stock by said second feed means;

said first drive control means including loop amount measuring means for measuring, as a loop amount, the difference between the amounts of sheet stock fed by said first and second feed means; first velocity reference generating means which generates, based on the feed rate by said second feed means, a first velocity reference signal for controlling said first feed means so that while said second feed means feed said sheet stock, said loop amount of said sheet stock is reduced to substantially zero and the feed rate by said first feed means follows the feed rate by said second feed means; second velocity reference generating means for generating a second velocity reference signal based on a predetermined creep velocity; and changeover means for selectively applying said first and second velocity reference generating means to said first feed means;

said first drive control means being operative, even while said second feed means is halted, to continue the feeding of said sheet stock by said first feed means at said creep velocity corresponding to said second velocity reference signal so as to cause a loop in said sheet stock to sag down between said first and second feed means, and said first drive control means being operative, after working of said sheet stock by said tool, to accelerate the feeding of said sheet stock by said first feed means in accordance with said first velocity reference signal so as to cause the amount of sheet stock fed by said second feed means to follow the amount of sheet stock fed by said second feed means in synchronization with the resumption of its feed, thereby minimizing the sag in said loop of sheet stock.

2. The feed line of claim 1 wherein said first velocity reference generating means includes means for adding together a loop amount signal proportional to said loop amount and a feed rate signal proportional to the feed rate by said second feed means and for outputting the result of said addition as said first velocity reference signal.

3. The feed line of claim 1 wherein said changeover means includes comparison means for comparing said first and second velocity reference signals, and a switch for connecting therethrough either one of the outputs of said first and second velocity reference generating means to said first feed means.

4. The feed line of claim 3 wherein said loop amount measuring means includes a reversible counter for counting up the feed amount of said second feed means and for counting down the feed amount by said first feed means, said reversible counter being reset to zero each time the output of said comparison means is inverted.

5. The feed line of claim 1 further including a loop sensor provided between said first and second feed means, for detecting the position of said loop, the output of said loop sensor being applied to said second drive control means to start the feed by said second feed means.

6. The feed line of claim 5 wherein said first drive control means includes a reversible counter which counts up the feed amount of said second feed means and counts down the feed amount of said first feed means.

7. The feed line of claim 6 wherein said reversible counter is a presettable reversible counter and means is provided for presetting a predetermined value in said reversible counter in response to the output of said loop sensor.

8. The feed line of claim 1 wherein said second velocity reference generating means includes: an oscillator for generating a pulse signal of a fixed frequency; difference signal generating means for generating a difference signal proportional to the difference between the number of pulses of said pulse signal counted during the stoppage of said second feed means and the feed amount of said first feed means; and means for adding together a frequency signal proportional to the frequency of said pulse signal and said difference signal and for providing the added output as said second velocity reference signal.

* * * * *